US008905510B2

(12) United States Patent
Moritaku

(10) Patent No.: US 8,905,510 B2
(45) Date of Patent: Dec. 9, 2014

(54) PRINTER

(71) Applicant: Seiko Epson Corporation, Tokyo (JP)

(72) Inventor: Toshimitsu Moritaku, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/223,731

(22) Filed: Mar. 24, 2014

(65) Prior Publication Data

US 2014/0292881 A1 Oct. 2, 2014

(30) Foreign Application Priority Data

Mar. 27, 2013 (JP) ..... 2013-065811

(51) Int. Cl.
*B41J 29/38* (2006.01)
*B41J 2/01* (2006.01)
*B41J 29/393* (2006.01)

(52) U.S. Cl.
CPC ..... *B41J 29/393* (2013.01)
USPC ..... 347/16; 347/104; 347/107

(58) Field of Classification Search
None
See application file for complete search history.

(56) References Cited

U.S. PATENT DOCUMENTS

| | | | | |
|---|---|---|---|---|
| 7,232,199 | B2 | 6/2007 | Shinkawa et al. | |
| 2005/0046658 | A1* | 3/2005 | Kojima | 347/19 |
| 2008/0074453 | A1* | 3/2008 | Furukawa | 347/14 |
| 2011/0211009 | A1* | 9/2011 | Fujinaga | 347/16 |

FOREIGN PATENT DOCUMENTS

JP 3794431 4/2006

* cited by examiner

*Primary Examiner* — Geoffrey Mruk
(74) *Attorney, Agent, or Firm* — Workman Nydegger

(57) ABSTRACT

A printer includes a transporting unit that performs a predetermined amount of continuous transporting with respect to a printing medium, a head that forms a designated number of unit images designated in advance from the beginning to the end of continuous transporting by ejecting ink onto the printing medium which is continuously transported by the transporting unit, a detection unit that detects a defect of the unit image formed by the head, and a control unit that controls the transporting unit, the head, and the detection unit. Here, the control unit increases the predetermined amount and the designated number based on a detection result of the defective image by the detection unit, and performs a process of reforming the unit image corresponding to the number of defective images while the continuous transporting is performed.

5 Claims, 5 Drawing Sheets

PRINTER

BACKGROUND

1. Technical Field

The present invention relates to a printer.

2. Related Art

A printer which includes a transporting unit that performs a predetermined amount of continuous transporting with respect to a printing medium, and a head that forms a designated number of unit images designated in advance from the beginning to the end of continuous transporting by ejecting ink onto the printing medium which is continuously transported by the transporting unit has already been well known. As an example of the printer, an ink jet printer may be given.

In addition, among the printers, there is a printer that includes a detection unit that detects defects (dot omission or the like) of the above-described unit image formed by the head.

Japanese Patent No. 3794431 is an example of the related art.

When a defect of the unit image is detected, it is necessary that re-formation of the unit image corresponding to the number of defective images be performed. For example, after formation of the above-described designated number of unit images is completed (in other words, after the predetermined amount of continuous transporting is completed), a user newly gives a command for re-formation to the printer to perform the re-formation.

However, in such a case, it takes time and effort of the user, and therefore there is a demand for a new method highly convenient for the user.

SUMMARY

An advantage of some aspects of the invention is that it provides a printer which is highly convenient for a user.

According to an aspect of the invention, there is provided a printer including: a transporting unit that performs a predetermined amount of continuous transporting with respect to a printing medium; a head that forms a designated number of unit images designated in advance from the beginning to the end of continuous transporting by ejecting ink onto the printing medium which is continuously transported by the transporting unit; a detection unit that detects a defect of the unit image formed by the head; and a control unit that controls the transporting unit, the head, and the detection unit. Here, the control unit may increase the predetermined amount and the designated number based on a detection result of the defective image by the detection unit, and perform a process of re-forming the unit image corresponding to the number of defective images while the continuous transporting is performed.

By the description of the present specification and accompanying drawings, other characteristics of the invention will be made clear.

BRIEF DESCRIPTION OF THE DRAWINGS

The invention will be described with reference to the accompanying drawings, wherein like numbers reference like elements.

DESCRIPTION OF EXEMPLARY EMBODIMENTS

By the descriptions of the present specification and accompanying drawings, at least the following matters will be made clear.

There is provided a printer including: a transporting unit that performs a predetermined amount of continuous transporting with respect to a printing medium; a head that forms a designated number of unit images designated in advance from the beginning to the end of continuous transporting by ejecting ink onto the printing medium which is continuously transported by the transporting unit; a detection unit that detects a defect of the unit image formed by the head; and a control unit that controls the transporting unit, the head, and the detection unit. Here, the control unit may increase the predetermined amount and the designated number based on a detection result of the defective image by the detection unit, and perform a process of re-forming the unit image corresponding to the number of defective images while the continuous transporting is performed.

According to the printer, it is possible to implement the printer which is highly convenient for a user.

The control unit may perform formation of the unit image so that a positional difference of two unit images adjacent to each other on the printing medium becomes the same value, and when the defective image is detected, the control unit may perform the formation of the unit image so that the positional difference of the two unit images becomes N times the value (N being a natural number of 2 or greater) while inserting a flushing pattern image between the two unit images.

In this case, it is possible to maintain as constant a pitch of a plurality of times of cutting continuously performed when performing cutting using a post-processing machine.

The control unit may perform formation of an alignment mark used for alignment in a post-processing machine for cutting the unit image, according to each of the unit images, but does not perform the formation of the alignment mark corresponding to the flushing pattern image.

In this case, it is possible to prevent an unnecessary portion from being cut when performing cutting using a post-processing machine.

The unit image may be a unit image with variable data having variable data, and the control unit may increase the predetermined amount and the designated number based on the detection result of the defective image by the detection unit and perform a process of re-forming the unit image with variable data having the variable data included in the defective image while the continuous transporting is performed.

In this case, it is possible to improve the user's convenience even when printing the unit image with variable data.

The control unit may re-form the unit image with variable data having the variable data included in the defective image after initial formation of the unit image with variable data is completed.

In this case, the re-formed unit image can be easily found.

Schematic Configuration Example of Printer 1

Figure 1:
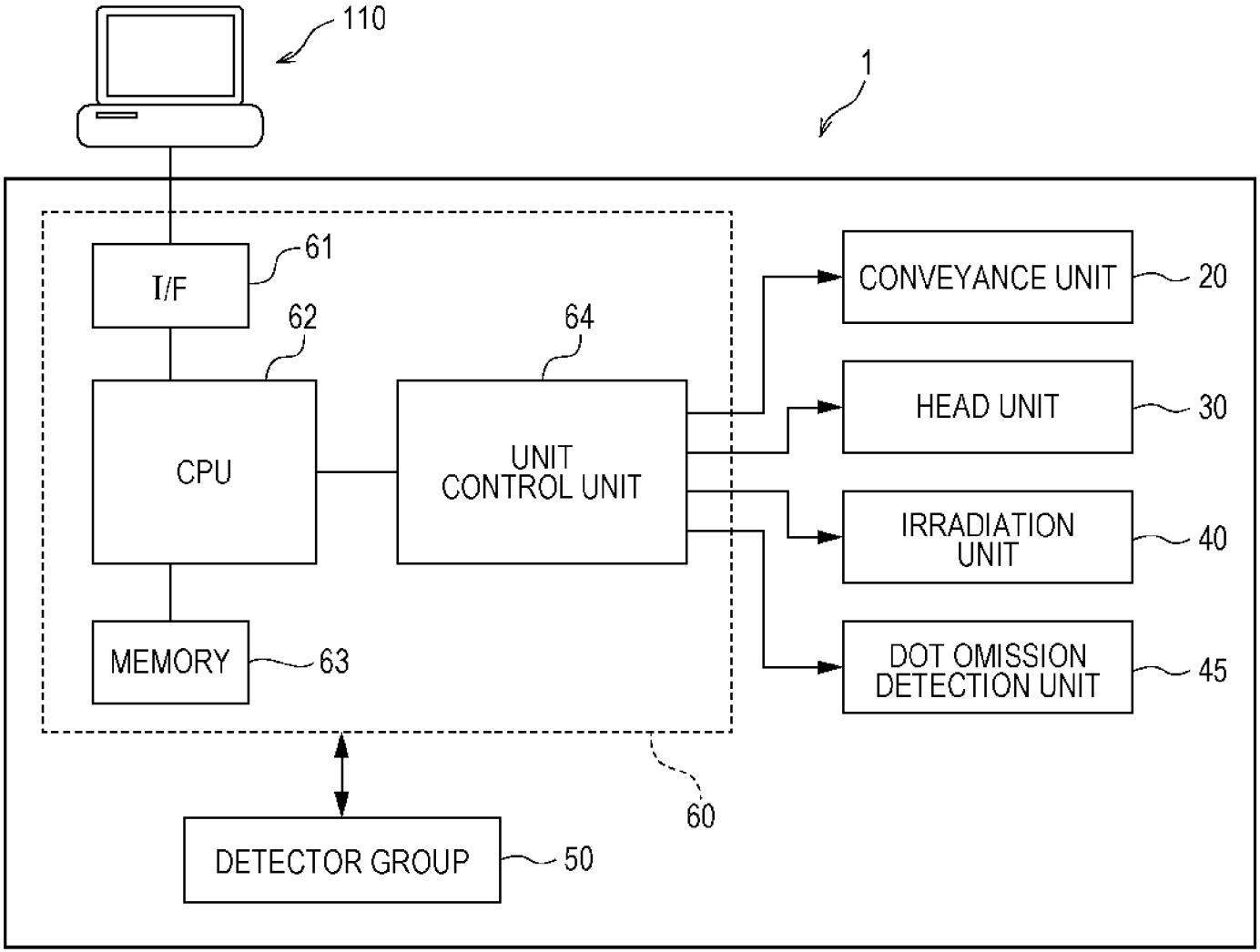
FIG. 1 is a block diagram illustrating an overall configuration of a printer.
Figure 2:
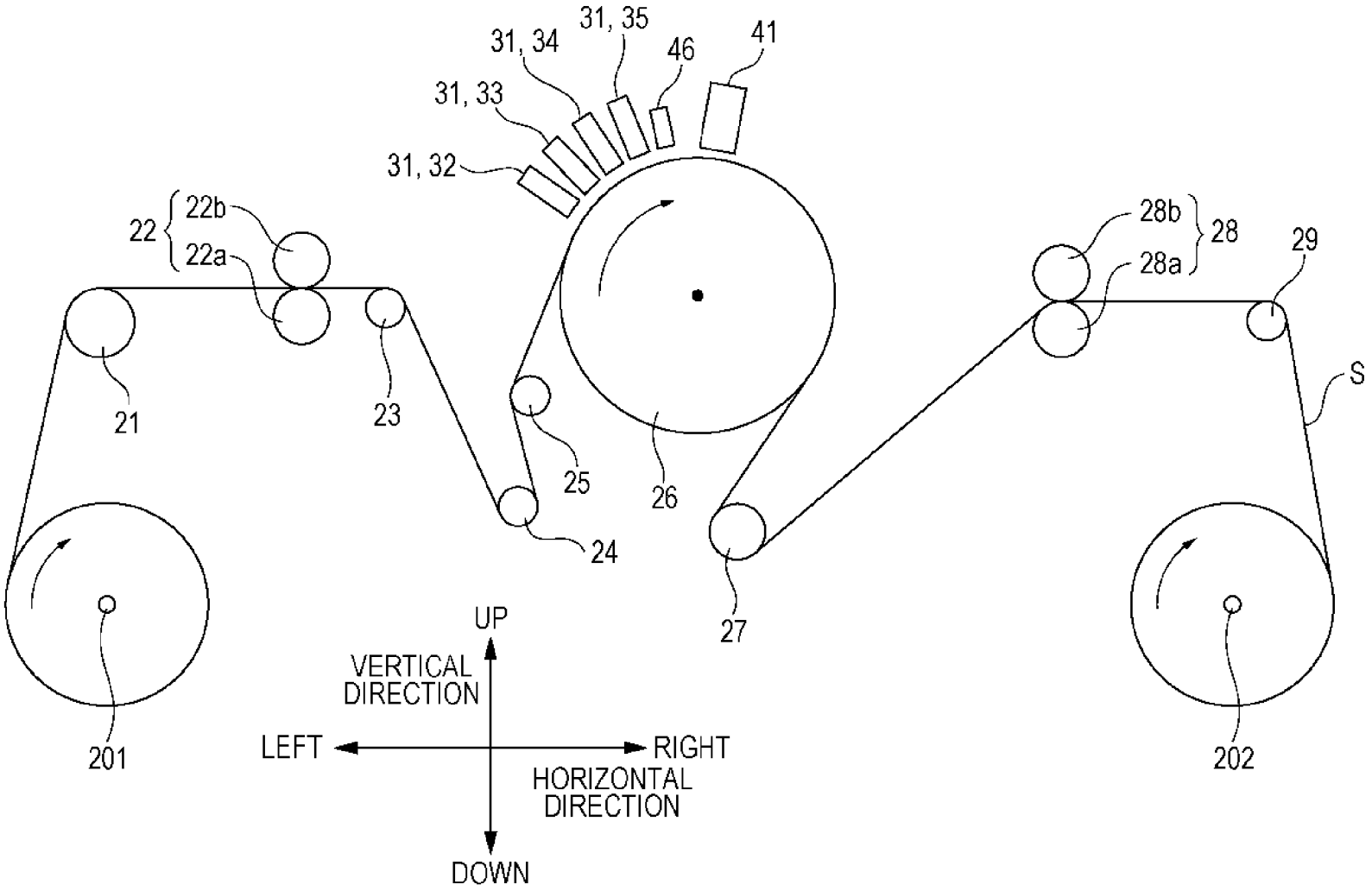
FIG. 2 is a schematic diagram illustrating a transporting path including a printing region.

FIG. 1 is a block diagram illustrating an overall configuration of an ink jet printer (hereinafter, simply referred to as printer 1) as an example of a printer. In addition, FIG. 2 is a schematic diagram illustrating a transporting path including a printing region.

The printer 1 is a printing device that prints images on a printing medium, and is communicably connected to a computer 110 that is an external device. In addition, in the present embodiment, as an example of the printing medium, on which images are printed by the printer 1, a medium (roll-shaped medium, hereinafter, specifically referred to as a "roll sheet S" (continuous paper)) such as paper or the like wound into a roll will be used and described.

In addition, the printer 1 according to the present embodiment is a so-called label printer, and prints a plurality of labels (corresponding to unit image) as an image (that is, repeatedly prints the same label).

In the computer 110, a printer driver is installed. The printer driver is a program that displays a user interface on a display device (not shown) and converts image data output from an application program into printing data. The printer driver is recorded on a recording medium (computer readable recording medium) such as a flexible disk FD or CD-ROM. Alternatively, it is possible to download the printer driver to the computer 110 via the Internet. In addition, this program may be constituted of codes for achieving various functions.

In order to print a label (unit image) in the printer 1, the computer 110 outputs, to the printer 1, printing data corresponding to the label (unit image) to be printed.

The printer 1 according to the present embodiment is a device that prints the label (unit image) on a printing medium by ejecting ultraviolet curable ink (hereinafter, referred to as "UV ink") cured by irradiation of ultraviolet rays (hereinafter, referred to as "UV") as an example of ink. The UV ink is ink containing UV curable resin, and is cured by occurrence of a photopolymerization reaction in the UV curable resin when irradiated with UV. In addition, the printer 1 according to the present embodiment prints an image using UV ink of four colors such as cyan, magenta, yellow, and black.

The printer 1 includes a transporting unit 20 as an example of a transporting unit, a head unit 30, an irradiation unit 40, a dot omission detection unit 45 as an example of a detection unit, a detector group 50 (excluding dot omission detection unit 45), and a controller 60 as an example of a control unit. The printer 1 which has received printing data from the computer 110 that is an external device controls each unit (transporting unit 20, head unit 30, irradiation unit 40, and dot omission detection unit 45) by the controller 60 to print a label (unit image) on the roll sheet S according to the printing data. The controller 60 controls each unit based on the printing data received from the computer 110 to print the label (unit image) on the roll sheet S. A status within the printer 1 is monitored by the detector group 50, and the detector group 50 outputs a detection result to the controller 60. The controller 60 controls each unit based on the detection result output from the detector group 50.

The transporting unit 20 transports the roll sheet S along a transporting path set in advance. As shown in FIG. 2, the transporting unit 20 includes a feeding shaft 201 on which the roll sheet S is wound and which is rotatably supported, a relay roller 21, a first transporting roller 22, a relay roller 23, an inversion roller 24, a contact roller 25, a transporting drum 26, a tension roller 27, a second transporting roller 28, a tension roller 29, and a roll sheet winding driving shaft 202 that winds the roll sheet S having passed through the tension roller 29.

The relay roller 21 is a roller on which the roll sheet S fed from the feeding shaft 201 is wound from a lower side (lower left in the drawing) to be transported to the right side in the horizontal direction.

The first transporting roller 22 includes a first driving roller 22*a* driven by a motor which is not shown, and includes a first driven roller 22*b* disposed so as to face the first driving roller 22*a* while holding the roll sheet S therebetween. By the driving of the first driving roller 22*a*, position control or speed control of the roll sheet S is performed.

The relay roller 23 is a roller on which the roll sheet S having passed through the first transporting roller 22 is wound from the left side in the horizontal direction to be transported to a lower right side.

The inversion roller 24 is a roller that inverts a transporting direction of the roll sheet S having passed through the relay roller 23.

The contact roller 25 is a roller on which the roll sheet S having passed through the inversion roller 24 is wound from a lower side in the vertical direction to be transported to the transporting drum 26.

The transporting drum 26 is a cylindrical transporting member, and transports the roll sheet S in the transporting direction while supporting the roll sheet S on peripheral surfaces thereof. In addition, the transporting drum 26 faces a head 31, an irradiation unit 41, and a line sensor 46, which will be described later, via the roll sheet S. In addition, the roll sheet S is transported so as to be adhered to the transporting drum 26 with predetermined tension.

The tension roller 27 is provided at a lower right side of the transporting drum 26, and inverts the transporting direction of the roll sheet S having passed through the transporting drum 26 to send the roll sheet S to the second transporting roller 28.

The second transporting roller 28 includes a second driving roller 28*a* driven by a motor which is not shown, and a second driven roller 28*b* disposed so as to face the second driving roller 28*a* while holding the roll sheet S therebetween. The second transporting roller 28 is a roller that transports a portion of the roll sheet S on which an image has been recorded by each head 31.

The tension roller 29 is a roller on which the roll sheet S having passed through the second transporting roller 28 is wound from the left in the horizontal direction to be transported to the roll sheet winding driving shaft 202 on a lower side in the vertical direction.

In this manner, the roll sheet S moves while passing through the respective rollers sequentially, whereby a transporting path for transporting the roll sheet S is formed.

The head unit 30 is used for ejecting UV ink onto the roll sheet S. The head unit 30 forms dots on the roll sheet S by ejecting the UV ink from each head 31 onto the roll sheet S which is currently transported in the transporting direction, and prints a label (unit image) on the roll sheet S.

In addition, each head 31 of the head unit 30 of the printer 1 according to the present embodiment may form dots corresponding to a paper width of the roll sheet S at once. That is, the head 31 is a so-called line head. Thus, the head 31 has a shape long in a paper width direction (in a direction penetrating a paper surface of FIG. 2) that is a crossing direction crossing the transporting direction, and nozzles are arranged in the paper width direction. The head 31 sequentially (repeatedly) prints raster lines by ejecting the UV ink from the nozzles onto the roll sheet S transported by the transporting unit 20 (thus, a plurality of raster lines are arranged in the transporting direction).

In addition, a piezoelectric element (not shown) as a driving element for ejecting ink droplets is provided in the nozzles. When applying voltage of a predetermined time width between electrodes provided at both ends of the piezoelectric element, the piezoelectric element is expanded in response to an application time of the voltage, thereby deforming a side wall (vibration plate) of a flow passage of the UV ink. Thus, the volume of the flow passage of the ink is contracted in response to expansion and contraction of the piezoelectric element, whereby ink in an amount corresponding to the contraction is discharged from the nozzles as ink droplets.

In addition, in the present embodiment as described above, UV ink of four colors for forming a label (unit image) is used as the UV ink. As shown in FIG. 2, sequentially from an upstream side in the transporting direction, respective heads 31 of a cyan ink head 32 for ejecting cyan UV ink, a magenta ink head 33 for ejecting magenta UV ink, a yellow ink head 34 for ejecting yellow UV ink, and a black ink head 35 for ejecting black UV ink are provided so as to face a circumferential surface of the transporting drum 26.

The irradiation unit 40 irradiates UV towards the UV ink impacting on the roll sheet S. Dots formed on the roll sheet S are cured in such a manner that the dots are irradiated with UV from the irradiation unit 40. The irradiation unit 40 in the present embodiment includes an irradiation unit 41. In addition, the irradiation unit 41 includes a lamp (metal halide lamp, mercury lamp, or the like) or LED as a light source of UV irradiation.

The irradiation unit 41 is provided on a downstream side of the black ink head 35 in the transporting direction. In other words, the irradiation unit 41 is provided on a downstream side of the head unit 30 in the transporting direction. The irradiation unit 41 cures the dots in such a manner that a unit image (dot) formed on the roll sheet S is irradiated with UV by the cyan ink head 32, the magenta ink head 33, the yellow ink head 34, and the black ink head 35.

The dot omission detection unit 45 is used for detecting defects of the label (unit image) formed by the head 31. In the present embodiment, by detecting dot omission due to nozzle clogging or the like (for example, the dot omission appears as a white streak), the defects of the label (unit image) are detected.

As shown in FIG. 2, the dot omission detection unit 45 includes the line sensor 46. The line sensor 46 is provided on a downstream side of the black ink head 35 in the transporting direction and on an upstream side of the irradiation unit 41 in the transporting direction. That is, the line sensor 46 is provided between the head unit 30 and the irradiation unit 41 in the transporting direction.

In addition, the line sensor 46 has a shape long in the above-described paper width direction (in the direction penetrating the paper surface of FIG. 2). The line sensor 46 sequentially reads the labels (unit image) formed on the transported roll sheet 2 for each read line while forming the labels (unit image). Reading of the image by the line sensor 46 is achieved in such a manner that the line sensor 46 is irradiated with light and reflection light of the irradiated light is detected using CCD (that is, a light quantity of the reflection light is detected by CCD so that read data based on the light quantity is output by the line sensor 46).

The dot omission detection unit 45 detects occurrence or non-occurrence of dot omission such as a white streak or the like based on the read data generated by the line sensor 46. Specifically, the dot omission detection unit 45 compares the read data and the above-described printing data. When there is a difference between the read data and the printing data which exceeds a threshold value, it is determined that dot omission such as the white streak or the like occurs.

A rotary encoder or the like is included in the detector group 50. The rotary encoder detects an amount of rotation of the first driving roller 22*a* or the second driving roller 28*a*. Based on a detection result of the rotary encoder, a transporting amount of the medium may be detected.

The controller 60 is a control unit (controller) for performing control of the printer 1. The controller 60 includes an interface unit 61, a CPU 62, a memory 63, and a unit control unit 64. The interface unit 61 performs transmission and reception of data between the computer 110 that is the external device and the printer 1. The CPU 62 is a computation processing unit for performing overall control of the printer. The memory 63 is used for ensuring a region for storing a program of the CPU 62 or a working region, and includes a storage element such as RAM, EEPROM, or the like. The CPU 62 controls each unit via the unit control unit 64 according to the program stored in the memory 63.

Regarding Printing Process

Figure 3:
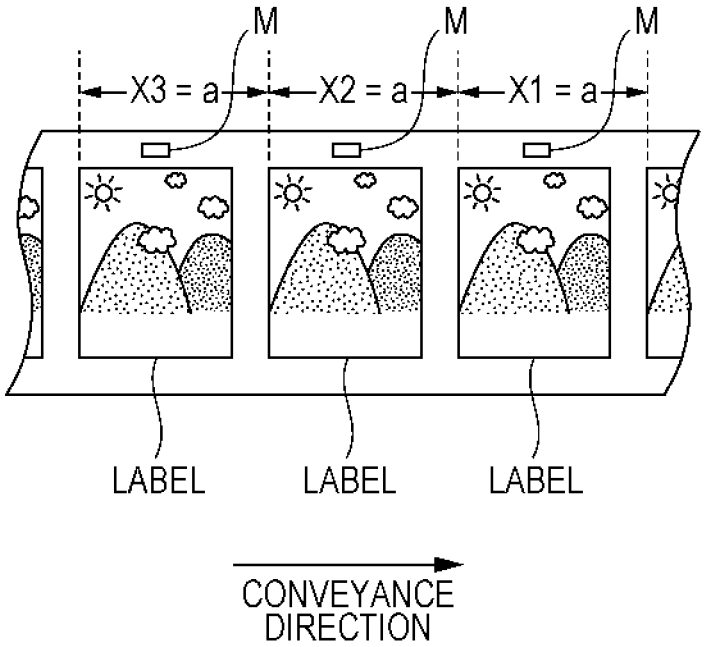
FIG. 3 is a schematic diagram illustrating a state in which a label (unit image) is printed on a roll sheet.

Hereinafter, an example of a printing process of the printer 1 will be described using FIG. 3. FIG. 3 is a schematic diagram illustrating a state in which a label (unit image) is printed on a roll sheet S.

In addition, the printing process is mainly achieved by the controller 60. In particular, in the present embodiment, the printing process is achieved by processing a program stored in the memory 63 by the CPU 62. This program is constituted of codes for performing various operations which will be described below.

When the printer 1 starts printing, in a state in which the roll sheet S has already been wound along the circumferential surface of the transporting drum 26, the roll sheet S is disposed on the transporting path. Tension is applied to the roll sheet S by an output torque of the feeding shaft 201, the roll sheet winding driving shaft 202, and the second transporting roller 28. Specifically, in a feeding portion of the roll sheet S, predetermined tension is applied by a brake torque of the feeding shaft 201 corresponding to a roll diameter of the roll sheet S. In a printing region, tension is detected in the tension roller 27, and a torque of the motor (not shown) of the second transporting roller 28 is controlled so as to obtain predetermined tension. In a winding portion, tension is detected in the tension roller 29, and a torque of the motor (not shown) of the roll sheet winding driving shaft 202 is controlled so as to obtain predetermined tension. These tensions are determined according to the roll diameter of the roll sheet S.

When the printer 1 receives printing data from the computer 110 (in other words, when receiving a job), the controller 60 rotates the motor (not shown) of the first transporting roller 22. As described above, the first transporting roller 22 is rotated in a state in which the tension is applied to the roll sheet S, and therefore the roll sheet S is continuously transported in the transporting direction (that is, repeatedly transported without stopping of the transporting).

That is, information relating to the number (that is, a designated number designated in advance by the user or the like) of labels (unit image) to be printed is included in the printing data, and therefore the controller 60 determines a transporting amount (length) of continuous transporting in one job, based on the designated number. Consequently, the controller 60 determines the length by which the roll sheet S should be transmitted in one job. The transporting unit 20 (first transporting roller 22) performs a determined predetermined amount of continuous transporting with respect to the roll sheet S.

In addition, the transporting drum 26 is rotated following transporting of the roll sheet S in an arrow direction (transporting direction) by a frictional force with the roll sheet S.

The roll sheet S on the circumferential surface of the transporting drum 26 is transported in the transporting direction in response to rotation of the transporting drum 26. In addition, the roll sheet S being transported is in close contact with the transporting drum 26. In the present embodiment, since positions of the respective heads 31 are fixed, the respective heads 31 and the roll sheet S are relatively moved in the transporting direction by transporting the roll sheet S in the transporting direction.

The respective heads 31 of the head unit 30 ejects UV ink onto the roll sheet S which is continuously transported by the transporting unit 20, based on printing data, to form the designated number of labels (unit image) on the roll sheet S from the beginning to the end of continuous transporting. That is, in one job, the predetermined amount of continuous transporting is performed, and the designated number of labels (unit image) is formed during the continuous transporting.

Furthermore, when the formed labels (unit image) reach a position facing the irradiation unit 41 by the above-described continuous transporting, the irradiation unit 40 irradiates UV to the labels (unit image) and cures UV ink on the roll sheet S, and when the formed labels (unit image) reach a position facing the line sensor 46 by the above-described continuous transporting, the dot omission detection unit 45 reads the labels (unit image) to inspect whether dot omission occurs.

By the above-described process, as shown in FIG. 3, a plurality of labels (unit image) are printed on the roll sheet S. In addition, an example shown in FIG. 3 is an example of when dot omission is not detected at all by inspection of the dot omission. An example of when dot omission is detected will be described in detail later.

In addition, in the present embodiment, the controller 60 (head 31) prints the labels (unit image) so that the labels (unit image) are regularly arranged. That is, as shown in FIG. 3, formation of the labels (unit image) is performed so that positional differences (that is, pitch in the transporting direction) ×1, ×2, ×3, . . . become the same value a on the roll sheet S as two labels (unit image) adjacent to each other.

Further, the controller 60 (head 31) according to the present embodiment prints a so-called eye mark M other than the labels (unit image). The eye mark M is an alignment mark used for alignment in a post-processing machine for cutting the labels (unit image) (different from the print 1). That is, the controller 60 (head 31) performs formation of the eye mark M in accordance with the respective labels (unit image) as shown in FIG. 3.

Regarding Process of when Dot Omission is Detected

Figure 4:
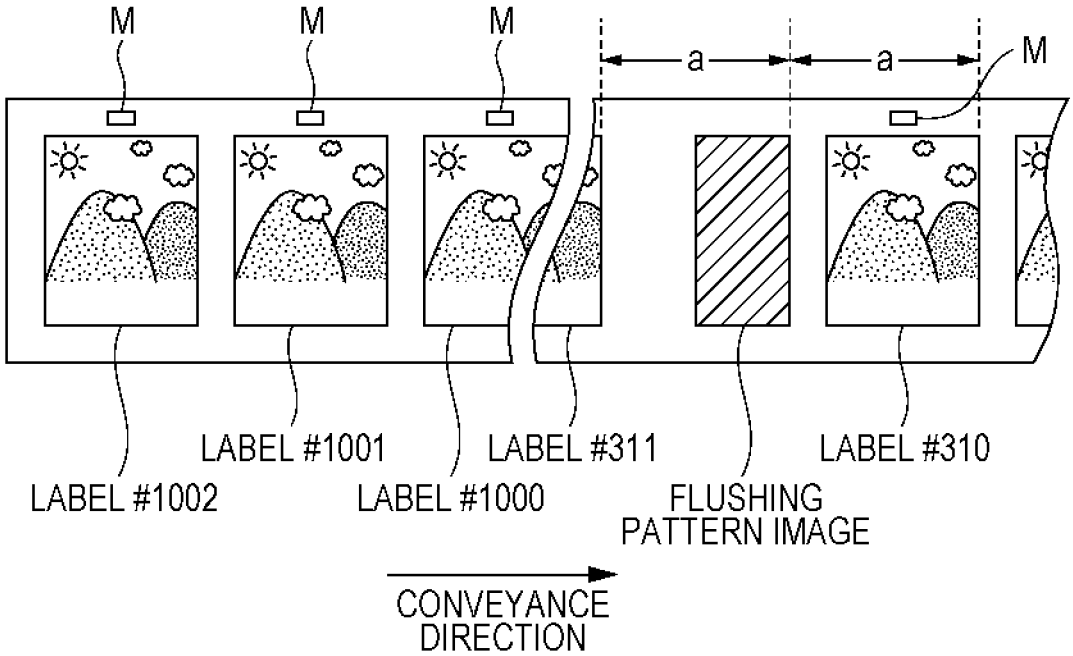
FIG. 4 is a schematic diagram illustrating a state of a label (unit image) on a roll sheet when dot omission is detected.

Next, a process of when dot omission is detected by the dot omission detection unit 45 will be described with reference to FIG. 4. FIG. 4 is a diagram corresponding to FIG. 3, and is a schematic diagram illustrating a state of the label (unit image) on the roll sheet S when dot omission is detected.

As described above, when receiving printing data (in other words, receiving a job), the controller 60 ascertains the number of labels (unit image) to be printed, that is, the number designated by the printing data. Next, based on the designated number, a transporting amount (length) of continuous transporting in one job, that is, the predetermined amount is determined. In the present example, in order to facilitate understanding, the designated number is 1000, and the predetermined amount is L meters.

The transporting unit 20 starts continuous transporting of L meters with respect to the roll sheet S. Next, by the head 31 and the dot omission detection unit 45, formation of the labels (unit image) and dot omission inspection of the formed labels (unit image) are sequentially performed.

Next, when a defective label is detected by the dot omission inspection (when dot omission is detected), the following two processes are mainly performed.

First, the controller 60 (head 31) forms a flushing pattern image in place of the next label (unit image). Here, the flushing pattern image is an image that is formed on the roll sheet S by performing flushing for the purpose of recovering from nozzle clogging of the head 31, and an image having a pattern suitable to recover from the nozzle clogging.

Specifically, in the present example, it is assumed that dot omission is detected in the 310th label and 700th label. In this case, as shown in FIG. 4 (only the 310th label is represented; representation of the 700th label will be omitted), the controller 60 (head 31) forms a flushing pattern image instead of (before) forming the 311st (701st) label next to the 310th label. Next, the 311st (701st) label is formed next to the flushing pattern image.

In other words, when a defective label is detected, the controller 60 (head 31) inserts the flushing pattern image between two labels (for example, the 310th label and the 311st label).

Further, in the present embodiment, regularity (regular arrangement) of the labels (unit image) is not disturbed even though the flushing pattern image is inserted.

That is, the controller 60 (head 31) performs formation of labels (unit image) so that the above-described positional difference (pitch) between the two labels is N times (N being a natural number of 2 or greater) the value a, while inserting the flushing pattern image between the two labels (for example, the 310th label and the 311st label). In addition, in the example shown in FIG. 4, the positional difference (pitch) of two labels (the 310th label and the 311st label) is 2a, and this example corresponds to an example of N=2. Thus, it is possible to increase a size of the flushing pattern image, and when a length of the flushing pattern image is greater than a, N can be 3 or greater. In all cases, when the flushing pattern image is inserted, the controller 60 (head 31) adjusts the positional difference (pitch) of the above-described two labels (unit image) so that the positional difference (pitch) of the above-described two labels (unit image) is a natural number multiple of a, thereby performing formation of the labels (unit image).

In addition, as described above, the controller 60 (head 31) forms the eye mark M in accordance with each label (unit image), but as shown in FIG. 4, formation of the eye mark M corresponding to the flushing pattern image is not performed.

In addition, second, the controller 60 changes and updates the designated number and the predetermined amount. Consequently, since the defective label is detected, the defective label is not available, and it is necessary that an alternative label (unit image) of the defective label is newly re-formed. Thus, the controller 60 increases the designated number and the predetermined amount based on a detection result of the defective label by the dot omission detection unit 45.

That is, when dot omission is detected in the 310th label, the controller 60 increases the designated number by one to update the designated number to 1001. Next, by increasing the predetermined amount by 2a (2a is obtained by adding an amount of the label to be re-formed and an amount of the flushing pattern image), the controller 60 updates the predetermined amount to L+2a.

Thereafter, when dot omission is detected in the 700th label, the controller 60 updates the designated number to 1002 by further increasing the designated number by one. Next, the controller 60 updates the predetermined amount to L+4a by further increasing the predetermined amount by 2a.

Next, finally, in one job, continuous transporting of L+4a meters is performed, and 1002 labels (unit image) (of these, the number of normal labels is 1000, and the number of defective labels is 2) are formed during the continuous transporting as shown in FIG. 4.

In this manner, the controller 60 performs a process of re-forming labels (unit image) corresponding to the number of defective labels while the continuous transporting is performed (in other words, during one job), by increasing the designated number and the predetermined amount based on the detection result of the defective labels by the dot omission detection unit 45.

Regarding Process in Case of Label with Variable Data

Figure 5:
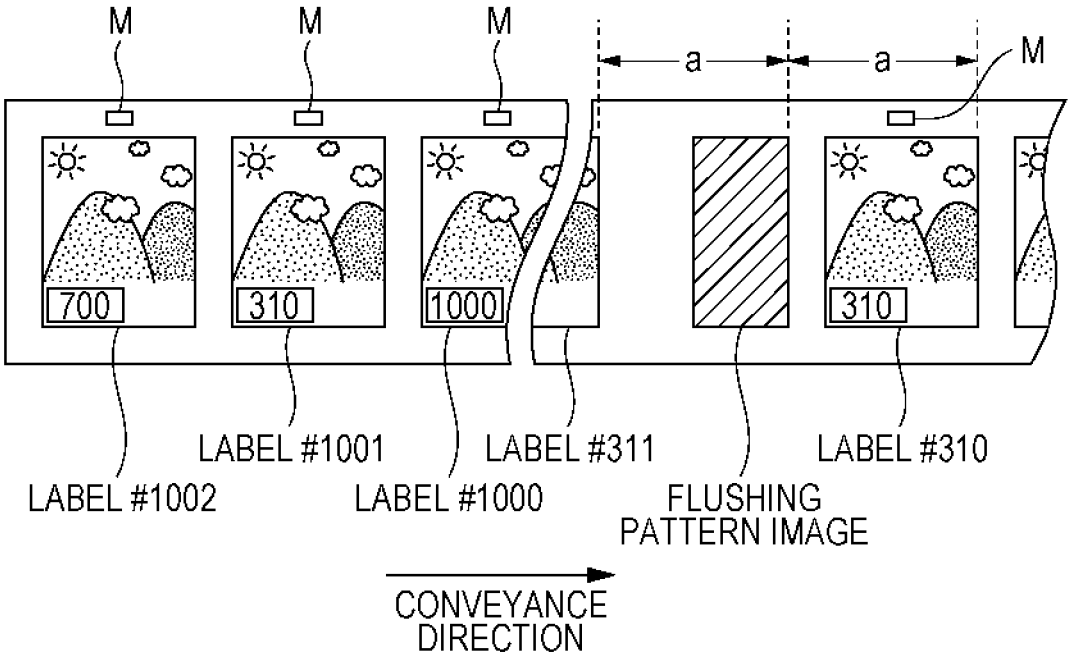
FIG. 5 is a schematic diagram illustrating a state of a label with variable data on a roll sheet when dot omission is detected.

Next, a process of when dot omission is detected in a case in which the label (unit image) is a label with variable data will be described with reference to FIG. 5. FIG. 5 is a diagram corresponding to FIGS. 3 and 4, and is a schematic diagram illustrating a state of the label with variable data on the roll sheet S when dot omission is detected.

In the example of FIG. 4, the case in which the same label (unit image) is repeatedly printed has been described. However, there is a case in which a portion (the varied portion is called variable data) of the label partially varied is present even though the same label is basically repeatedly printed. In such a case, there is a slight difference with an example of the label without variable data, and therefore the process of when dot omission is detected will be described with reference to FIG. 5. In addition, in an example shown in FIG. 5, a label number enclosed in square, which is positioned in a lower left side of the label (unit image), corresponds to the variable data.

When receiving the printing data (in other words, when receiving a job), the controller 60 ascertains the number of labels (unit image) to be printed, that is, the number designated by the printing data. Next, based on the designated number, a transporting amount (length) of continuous transporting in one job, that is, the predetermined amount is determined. Also in this example, in order to facilitate understanding, it is assumed that the designated number is 1000 and the predetermined amount is L meters.

The transporting unit 20 starts continuous transporting of L meters corresponding to the roll sheet S. Next, the head 31 and the dot omission detection unit 45 sequentially perform formation of the labels (unit image) and dot omission inspection of the labels (unit image).

Next, when a defective label is detected by the dot omission inspection (when dot omission is detected), the following two processes are mainly performed in the same manner as in the example of the label without variable data.

First, the controller 60 (head 31) forms a flushing pattern image in place of the next label (unit image). That is, also in this example, when it is assumed that dot omission is detected in the 310th label and the 700th label, the controller 60 (head 31) forms a flushing pattern image instead of (before) forming the 311st (701st) label next to the 310th label as shown in FIG. 5 (only the 310th label is represented; representation of the 700th label will be omitted). Next, the 311st (701st) label is formed next to the flushing pattern image.

In addition, second, the controller 60 changes (updates) the designated number and the predetermined amount. Consequently, the controller 60 increases the designated number and the predetermined amount based on the detection result of the defective label by the dot omission detection unit 45.

That is, when dot omission is detected in the 310th label, the controller 60 updates the designated number to 1001 by increasing the designated number by one in the same manner as that of the label without variable data. Next, the controller 60 updates the predetermined amount to L+2a by increasing the predetermined amount by 2a.

In addition, the controller 60 performs the following process which is not performed in the example of the label without variable data. That is, the controller 60 specifies which ordinal number of label is the label in which dot omission is detected. This is specified based on an output value of the above-described rotary encoder. Next, the controller 60 ascertains variable data ("310" in the present example) described in the specified label (unit image), based on the printing data. Consequently, the controller 60 ascertains what the variable data included in the defective label was.

Thereafter, when dot omission is detected in the 700th label, the controller 60 updates the designated number to 1002 by further increasing the designated number by one. Next, the controller 60 updates the predetermined amount to L+4a by further increasing the predetermined amount by 2a. In addition, the controller 60 ascertains what the variable data ("700") included in the defective label (the 700th label) was.

Thereafter, when 1000 labels are formed (see FIG. 5), initial formation of the label with variable data is completed (of these, the number of normal labels is 998 and the number of defective labels is 2), but the label with variable data having variable data included in the defective label is re-formed after the completion. That is, as shown in FIG. 5, the label with variable data having "310" as the variable data and the label with variable data having "700" are re-formed in the stated order (that is, in the order in which a defect (dot omission) is detected).

Finally, in one job, continuous transporting of L+4a meters is performed, so that 1002 labels (unit image) (of these, the number of normal labels is 1000 and the number of defective labels is 2) are formed during the continuous transporting as shown in FIG. 5.

In this manner, the controller 60 performs a process of re-forming labels (unit image) corresponding to the number of defective labels by increasing the designated number and the predetermined amount based on the detection result of the defective labels by the dot omission detection unit 45 in the same manner as that of the label without variable data, while the continuous transporting is performed (in other words, during one job).

Regarding Effectiveness of Printer 1 According To Present Embodiment

As described above, the printer 1 according to the present embodiment includes the transporting unit 20 that performs a predetermined amount of continuous transporting with respect to the roll sheet S, the head 31 that ejects UV ink onto the roll sheet S continuously transported by the transporting unit 20 to form a designated number of labels (unit image) designated in advance from the beginning to the end of the continuous transporting, the dot omission detection unit 45 that detects a defect of the label (unit image) formed by the head 31, and the controller 60 that controls the transporting unit 20, the head 31, and the dot omission detection unit 45. The controller 60 performs a process of re-forming labels corresponding to the number of defective labels (unit image) by increasing the designated number and the predetermined amount based on the detection result of the defective labels by the dot omission detection unit 45, while the continuous transporting is performed. Therefore, it is possible to achieve the printer 1 which is highly convenient for the user.

That is, as described above, when a defect of the label (unit image) is detected, it is necessary to perform re-formation of the labels (unit image) corresponding to the number of defective labels. In this case, it can be considered that the user newly gives a command for re-formation to the printer 1 to perform the re-formation after formation of the designated number of labels (unit image) (for example, 1000 counts) is completed (in other words, after the predetermined amount (for example, L meters) of continuous transporting is completed). However, in such a case, it takes time and effort of the user, and therefore there is a demand for a new method highly convenient for the user.

In contrast, the printer 1 according to the present embodiment may respond to such demand. That is, in the present embodiment, the process of re-forming the labels (unit image) corresponding to the number of defective labels by increasing the designated number and the predetermined amount based on the detection result of the defective label by the dot omission detection unit 45 is performed while the continuous transporting is performed (in other words, in one job), and therefore, when one job (continuous transporting) is completed without the user particularly giving the command to the printer 1, re-formation of the labels (unit image) corresponding to the number of defective labels is automatically completed. Therefore, it is possible to achieve the printer 1 which is highly convenient for the user.

In addition, in the above-described embodiment, the controller 60 performs a process of re-forming the unit image with variable data having variable data included in the defective label by increasing the designated number and the predetermined amount based on the detection result of the defective label by the dot omission detection unit 45 while the continuous transporting is performed. Therefore, even when the label with variable data is printed, it is possible to improve convenience of the user.

In addition, in the above-described embodiment, the controller 60 (head 31) does not perform formation of the eye mark M in accordance with the flushing pattern image while performing formation of the eye mark M in accordance with each label (unit image). Therefore, when performing cutting using the above-described post-processing machine, it is possible to prevent an unnecessary portion from being cut.

Other Embodiments

The embodiment described above is intended to facilitate understanding of the invention, and does not limit the invention. The invention may be changed or modified without departing from the spirit, and it is needless to say that the equivalents are included in the invention. In particular, even in the embodiment which will be described below, they are included in the invention.

In the above-described embodiment, the roll sheet S has been described as an example of the printing medium, but the printing medium is not limited to paper. For example, film or fabric may be used.

In addition, in the above-described embodiment, the UV ink has been described as an example of the ink, but the ink is not limited to this. For example, other ink may be used.

In addition, in the above-described embodiment, the cylindrical member (that is, the transporting drum 26) having a curved surface has been described as a member for supporting the roll sheet S against the head 31, but the member for supporting the roll sheet S is not limited thereto. For example, a member having a plane surface may be used.

In addition, in the above-described embodiment, the dot omission detection unit 45 having the line sensor 46 has been described as an example of the detection unit for detecting a defect of an image, but the detection unit is not limited thereto. For example, an NSA method (method of detecting dot omission based on residual vibration of the vibration plate after applying an ink ejection waveform) described in Japanese Patent No. 3794431 may be used.

In addition, in the above-described embodiment, an example in which the line sensor 46 is provided between the head unit 30 and the irradiation unit 41 in the transporting direction has been described, but the invention is not limited thereto. For example, the line sensor 46 may be provided on a downstream side of the irradiation unit 41 in the transporting direction.

In addition, in the above-described embodiment, only one line sensor 46 is provided, but the invention is not limited thereto. For example, four line sensors 46 may be provided in accordance with the respective four heads 31. That is, the first line sensor may be provided between the cyan ink head 32 and the magenta ink head 33 in the transporting direction, the second line sensor may be provided between the magenta ink head 33 and the yellow ink head 34 in the transporting direction, the third line sensor may be provided between the yellow ink head 34 and the black ink head 35 in the transporting direction, and the fourth line sensor may be provided on a downstream side of the black ink head 35 in the transporting direction.

In addition, in the above-described embodiment, an example in which the flushing pattern image is formed on the roll sheet S when the defective label is detected has been described, but the invention is not limited thereto. For example, the flushing pattern image may not be formed.

In addition, whether or not the flushing pattern image is formed may be determined when the defective label is detected. For example, in a case in which the flushing pattern image is basically formed but the line sensor 46 sequentially reads the labels (unit image) formed on the transported roll sheet 2 for each read line, when dot omission is detected in the read line in which the label (unit image) is present but dot omission is not detected in the read line after the detection, formation of the flushing pattern image may be omitted.

Figure 6:
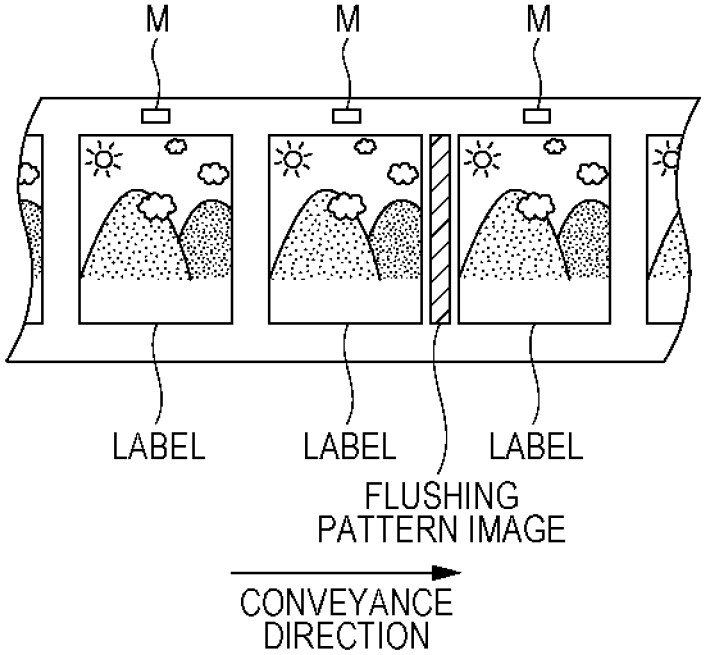
FIG. 6 is a schematic diagram illustrating a state of a label (unit image) on a roll sheet when dot omission is detected according to a first modification example.

In addition, in the above-described embodiment, the controller 60 (head 31) forms the flushing pattern image in place of the next label (unit image), but the invention is not limited thereto. For example, as shown in FIG. 6, the flushing pattern image may be formed in a gap region (generally, called ditch area) formed in advance between two labels (unit image).

However, from the viewpoint that it is possible to increase an amount of the ink in the flushing, the above-described embodiment is desirable.

In addition, in the above-described embodiment, the controller 60 (head 31) performs formation of the label (unit) so that a positional difference (that is, pitch) on the roll sheet S of two labels (unit image) adjacent to each other is the same value a, and when a defective label is detected, the controller 60 (head 31) performs formation of the label (unit image) so that the positional difference (pitch) of the two labels (unit image) is N times the value a (N being a natural number of 2 or greater) while inserting the flushing pattern image between the two labels (unit image).

Figure 7:
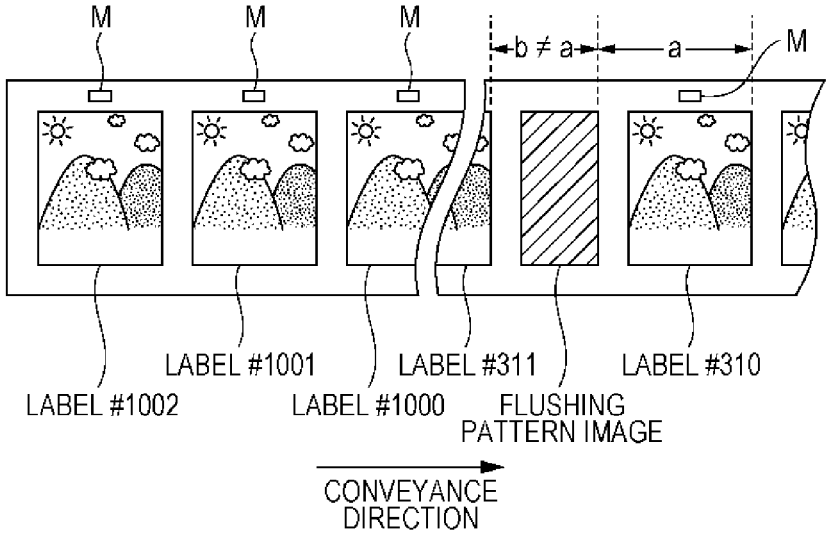
FIG. 7 is a schematic diagram illustrating a state of a label (unit image) on a roll sheet when dot omission is detected according to a second modification example.

However, the invention is not limited thereto. As shown in FIG. 7, the positional difference (pitch) may not be N times the value a considering saving the roll sheet S.

However, in the above-described embodiment, regardless of the flushing pattern image being inserted, it is possible to maintain as constant a pitch (that is, an interval between any one cutting and the next cutting) of a plurality of times of cutting when cutting the labels (unit image) using the above-described post-processing machine (thus, the use of an inexpensive post-processing machine having only a cutting function in the same pitch may be possible). In this regard, the above-described embodiment is desirable.

In addition, in the above-described embodiment, the controller 60 (head 31) re-forms the label with variable data having variable data included in the defective label after initial formation of the label with variable data is completed. That is, in the example of FIG. 5, the controller 60 (head 31) re-forms the label with variable data having "310" and the label with variable data having "700" after the initial formation is completed in such a manner that the 1000th label is formed, but the invention is not limited thereto.

For example, before the 1000th label is formed, the label with variable data having "310" or the label with variable data having "700" may be re-formed.

However, in the above-described embodiment, since replacement (the defective label with variable data and the re-formed label which mutually have the same variable data are peeled off, and the re-formed label is stuck in a position in which the defective label is present) is performed after printing is completed, it is possible to facilitate finding the re-formed label, that is, to specify a position of the re-formed label among the plurality of arranged labels because the re-formed labels are printed finally at the same time the re-formed label is peeled off. In this regard, the above-described embodiment is desirable.

The entire disclosure of Japanese Patent Application No. 2013-065811, filed Mar. 27, 2013 is expressly incorporated by reference herein.

What is claimed is:

1. A printer comprising:

a transporting unit that performs a predetermined amount of continuous transporting with respect to a printing medium;

a head that forms a designated number of unit images designated in advance from the beginning to the end of continuous transporting by ejecting ink onto the printing medium which is continuously transported by the transporting unit;

a detection unit that detects a defect of the unit image formed by the head; and a control unit that controls the transporting unit, the head, and the detection unit, wherein the control unit increases the predetermined amount and the designated number based on a detection result of the defective image by the detection unit, and performs a process of re-forming the unit image corresponding to the number of defective images while the continuous transporting is performed.

2. The printer according to claim 1, wherein the control unit performs formation of the unit image so that a positional difference of two unit images adjacent to each other on the printing medium becomes the same value, and wherein when the defective image is detected, the control unit performs the formation of the unit image so that the positional difference of the two unit images becomes N times the value (N being a natural number of 2 or greater) while inserting a flushing pattern image between the two unit images.

3. The printer according to claim 2, wherein the control unit performs formation of an alignment mark used for alignment in a post-processing machine for cutting the unit image, according to each of the unit images, but does not perform the formation of the alignment mark corresponding to the flushing pattern image.

4. The printer according to claim 1, wherein the unit image is a unit image with variable data having variable data, and wherein the control unit increases the predetermined amount and the designated number based on the detection result of the defective image by the detection unit and performs a process of re-forming the unit image with variable data having the variable data included in the defective image while the continuous transporting is performed.

5. The printer according to claim 4, wherein the control unit re-forms the unit image with variable data having the variable data included in the defective image after initial formation of the unit image with variable data is completed.

* * * * *